US005976431A

United States Patent [19]

Mears

[11] Patent Number: 5,976,431

[45] **Date of Patent: *Nov. 2, 1999**

[54] MELT SPINNING PROCESS TO PRODUCE FILAMENTS

[75] Inventor: Ronald Mears, Sudetenstrasse 25, D-63785, Obernburg, Germany

[73] Assignee: Ronald Mears, D-63785 Obernburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,995

[22] Filed: Jan. 17, 1997

Related U.S. Application Data

[63] Continuation of application No. 08/500,918, filed as application No. PCT/IB94/00380, Dec. 2, 1994, abandoned.

[30] Foreign Application Priority Data

Dec. 3, 1993 [CH] Switzerland ..... 3610/9314
Dec. 2, 1994 [WO] WIPO ..... PCT/IB94/00380

[51] Int. Cl.[6] ..... D01D 5/092; D01D 5/096; D01D 5/16

[52] U.S. Cl. ..... 264/40.1; 264/101; 264/103; 264/130; 264/210.8; 264/211.12; 264/211.14; 425/72.2; 425/135; 425/377; 425/378.2; 425/379.1; 425/382.2; 425/464

[58] Field of Search ..... 264/101, 103, 264/211.12, 211.14, 40.1, 130, 210.8; 425/72.2, 377, 378.2, 379.1, 382.2, 464, 135

[56] References Cited

U.S. PATENT DOCUMENTS

| | | | |
|---|---|---|---|
| 2,252,684 | 8/1941 | Babcock | 425/72.2 |
| 3,611,485 | 10/1971 | Leybourne, III et al. | 425/445 |
| 3,706,826 | 12/1972 | Bremner et al. | 264/211.15 |
| 3,707,593 | 12/1972 | Fukada et al. | 264/211.14 X |
| 4,049,763 | 9/1977 | Mineo et al. | 264/211.12 |
| 4,185,062 | 1/1980 | Luzzatto | 264/211.14 |
| 4,202,855 | 5/1980 | Gerking et al. | 264/211.14 X |
| 4,496,505 | 1/1985 | Tanji et al. | 264/101 |
| 4,702,871 | 10/1987 | Hasegawa et al. | 264/101 |
| 4,863,662 | 9/1989 | Hasegawa et al. | 264/211.14 X |
| 4,973,236 | 11/1990 | Hasegawa et al. | 425/72.2 |
| 5,034,183 | 7/1991 | Blewett | 376/107 |
| 5,141,700 | 8/1992 | Sze | 264/211.14 X |
| 5,360,589 | 11/1994 | Wandel et al. | 264/211.12 |

FOREIGN PATENT DOCUMENTS

| | | |
|---|---|---|
| 530 652 | 3/1993 | European Pat. Off. . |
| 580 977 | 2/1994 | European Pat. Off. . |
| 613 966 | 9/1994 | European Pat. Off. . |
| 468 482 | 3/1969 | Switzerland . |

*Primary Examiner*—Leo B. Tentoni
*Attorney, Agent, or Firm*—Alston & Bird LLP

[57] ABSTRACT

Filament stress in a newly spun filament is reduced in that the air friction between the filament and the contiguous air layer is prevented or limited. For this purpose an air current is generated, flowing in the running direction of the yarn at a speed which is the same or approximately the same as the surface speed of the filament. The air current can be guided on to the filament surface through a tube.

30 Claims, 3 Drawing Sheets

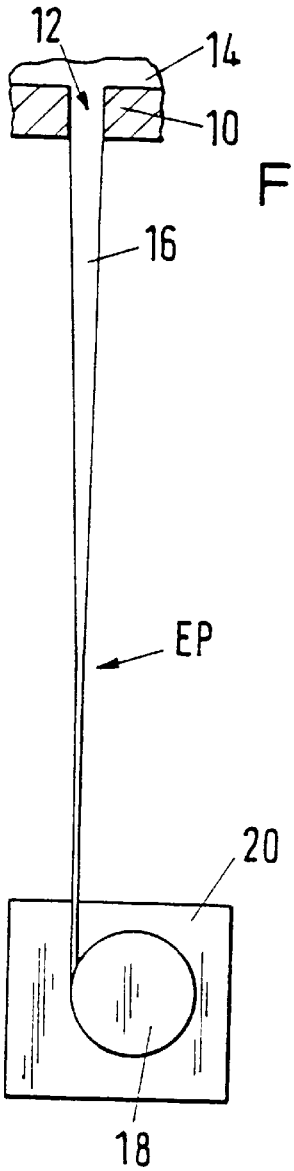
Fig. 1
Fig. 2
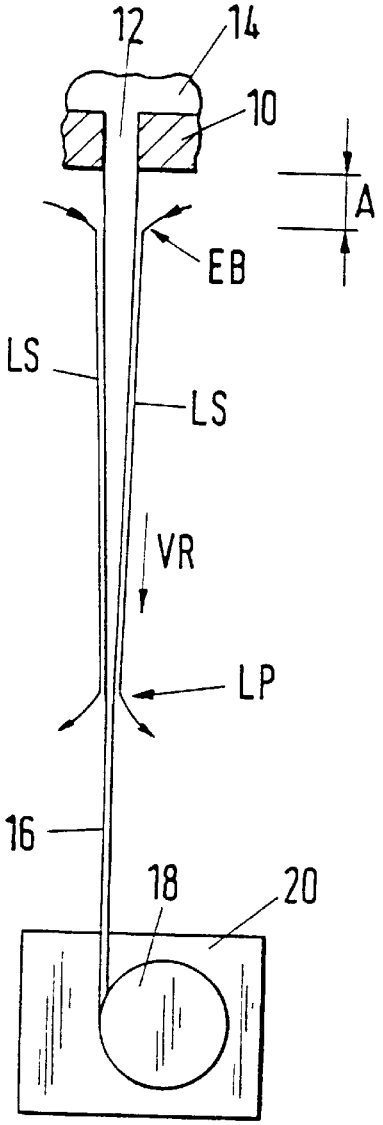

MELT SPINNING PROCESS TO PRODUCE FILAMENTS

This application is a continuation, of application Ser. No. 08/500,918, filed Sep. 6, 1995, now abandoned; which is a national stage 35 U.S.C. 371 of PCT/IB94/00380; filed Dec. 2, 1994.

BACKGROUND OF THE INVENTION

The invention concerns a process for producing (spinning) filaments made, e.g., from polyester, polyamide (polycondensate) or polypropylene. Devices appropriate to the process are also proposed.

For reasons of efficiency, increasing the delivery speed of filaments formed by pressing a melt through a spinning nozzle is a constantly sought objective. The magnitude of this "delivery speed" is not an absolute value that can be applied to every spinning process. Rather, it depends on the yarn which is to be spun. There is a fundamental distinction, for example, between technical and textile yarns, and textile yarns themselves are now being spun as either POY (partially oriented yarn) or FDY (Fully Drawn Yarn).

The pursuit of higher delivery speeds is currently limited by known effects of the delivery speed, these effects resulting mainly from changes in the morphology of the polymer from which the filament is formed. These changes, for example, reduce the strength or stretch of the yarn so that it is no longer suitable for its intended purpose. This also applies, indirectly, to cases in which the process ceases to be controllable at higher speeds, resulting in uncontrollable changes (and consequently non-uniform yarn characteristics) and/or yarn breakages (running problems).

1. Object of the Invention

The object of this invention is to achieve increased delivery speed while maintaining the same yarn characteristics and/or improved yarn characteristics while maintaining the same speed.

2. Prior Art

It has been known in the art for at least twenty years that, at higher delivery speeds, the frictional forces between the yarn and its accompanying or contiguous air layer can affect the yarn characteristics that can be achieved (U.S. Pat. No. 4,049,763). At the same time, it has been proposed to prevent these frictional forces by generation of an "assisted" accompanying air current to restore the positive characteristics of the slow process (U.S. Pat. No. 4,185,062 and U.S. Pat. No. 4,202,855). The proposed solution—an accompanying air current—had been proposed a long time previously, but for other reasons (U.S. Pat. No. 2,252,684). The term "assisted accompanying air current" here denotes the effect of special devices which generate an accompanying air current which is distinguished from an accompanying air current which is produced in any case as a result of entrainment with the yarn as the latter passes through the air. The above proposals all provided for the generation of the assisted air current following solidification of the yarn.

At the same time, it was proposed to subject the yarn to a tensile force before it had become solidified (U.S. Pat. No. 3,706,826). This tensile force can be generated by an air current. A similar proposal appears again somewhat later in U.S. Pat. No. 4,49 6,505 (=EP56 963), in which the air current is generated by an aspirator, following passage of the yarn through a heating zone adjoining the spinning nozzle. The heating zone is not included in WO 90/02222, in which the aspirator is connected to the spinning nozzle through a "spinning chamber".

Related or modified proposals have subsequently been put forward; for example, the proposal whereby, following passage through the spinning nozzle, the yarn passes through a shaft in which a predefined pressure is maintained (U.S. Pat. No. 4,702,871; 4,863,662 and U.S. Pat. No. 4,973,236). Special sealing devices are required to maintain the pressure within the shaft. This problem is circumvented in U.S. Pat. No. 5,034,183 and U.S. Pat. No. 5,141,700 (=EP-244217) in that the air (after it has been used for maintaining a predefined pressure) is discharged from the shaft at an increased speed.

The objectives of these latter proposals are not made clear. All are obviously intended to produce advantageous effects of one type or another. The patent specifications mentioned do not state whether phenomena other than empirically determined phenomena are involved. In some cases, the descriptions indicate the objective of selective application of a tensile force to the yarn close to the spinning nozzle.

For reasons of completeness, reference is made here to devices used for delivering yarns in the formation of non-woven products (e.g. U.S. Pat. No. 3,707,593). These devices are not relevant to the present invention, for reasons already stated in EP 244217 and not repeated here.

BASIC CONCEPT

The invention is based on knowledge which is described in part in the article "Rapid Spinning of Polyamide 6.6" by Dr. H. Breuer et al. in the journal "Chemiefasern/Testilindustrie" (Chemical Fibers/Textile Industry), September 1992, Page 662 ff. According to this knowledge, the characteristics of rapidly spun polycondensate which are relevant to textile production technology and morphology are largely independent of the spinning conditions, with only the spinning rate exercising any distinct effect.

The invention is based on the further knowledge that the effect of the spinning speed is actually applied through the load on the yarn (the filament stress), up to the point at which it becomes solid. The invention therefore employs measures which selectively affect this stress and, consequently, the yarn characteristics.

SUMMARY OF THE INVENTION

A first aspect of the in vention proposes a melt spinning process in which a stream of air is generated on the surface of the yarn, in the running direction of the yarn, characterized in that the stream of air flows over at least a part of the length of the yarn in which the polymer material has not yet solidified and in that the speed of the stream of air over this partial length of the yarn, in the direction of the yarn feed, is such that the yarn is not subjected to stress due to friction between the yarn and the contiguous air layer, or is subjected to only a negligible amount of such stress.

The yarn is delivered preferably to a winding device and, within that, to a bobbin (package), at a predefined speed. The winding speed can be such that, unless assisted by the stream of air in the direction of the yarn feed, the yarn speed prevailing from a predefined point in the spinning line would be such that the friction between the yarn and the contiguous air layer would subject the yarn to additional stress which would affect the yarn characteristics. According to the invention, an air current is generated from the said point, having a speed in the running direction of the yarn such that the frictional forces between the yarn and the contiguous air layer remain below a limit at which they can significantly affect the yarn characteristics.

The air current accompanies the yarn preferably at least to a point in the spinning line at which the yarn characteristics can no longer be essentially influenced by the said frictional forces, i.e., up to a point close to that at which the polymer material has solidified. Up to that point, the air current is kept at such a speed that the unwanted frictional forces are not produced.

The air current is generated preferably in such a way that it flows as uniformly as possible in the direction of the yarn feed, i.e., so that it exhibits minimum turbulence and exerts minimal lateral forces on the yarn.

A second aspect of the invention proposes a melt spinning process according to which the yarn is delivered to a winding device in which it is wound on to a bobbin at a predefined speed, the winding speed being set at a level such that, unless assisted by the stream of air in the running direction of the yarn, "necking" would occur in the yarn run, characterized in that stream of air in the running direction of the yarn is assisted so that necking is prevented.

The first aspect of the invention can be combined advantageously with the second aspect, particular advantages being achieved by the fact that the yarn stress upon solidification is reduced in two ways, namely, that the forces acting on the yarn are reduced and the tapering (necking) of the yarn prior to solidification is prevented.

BRIEF DESCRIPTION OF THE DRAWINGS

Embodiments of the invention are explained in greater detail with reference to the FIGS, as follows.

FIG. 1 shows a schematic representation of the thread run (the spinning line) between the nozzle plate and the winder (spooler) in a modern POY filament spinning process.

FIG. 2 shows a corresponding representation of the new method according to this invention.

DETAILED DESCRIPTION OF THE PREFERRED EMBODIMENTS

Figure 3:
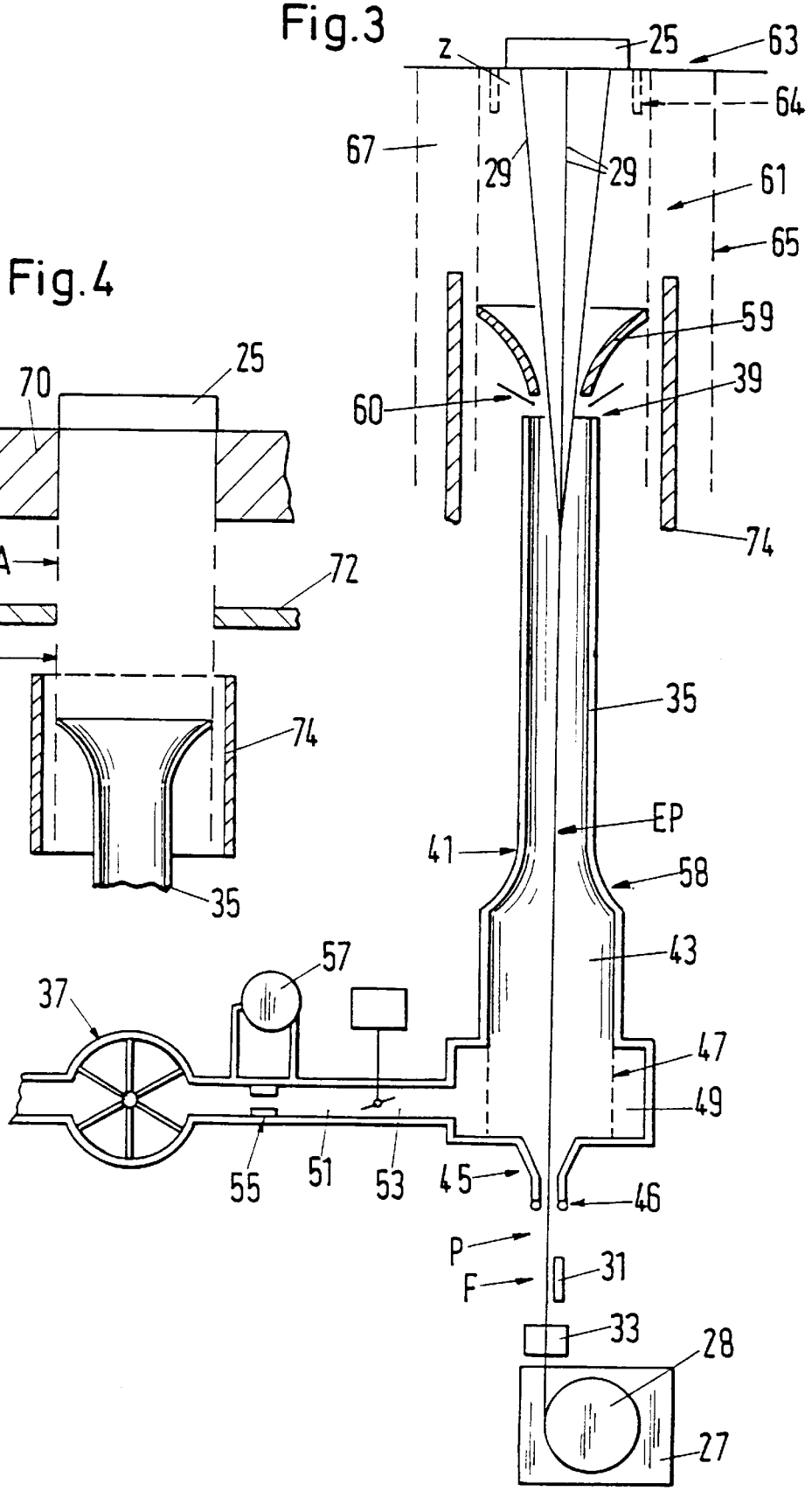
FIG. 3 shows a schematic representation of a device for realizing a process according to FIG. 2.

The invention is firstly described with reference to a highly simplified spinning line, so that the description is not complicated by explanations of secondary aspects. For this reason,a POY process has been chosen as an example. The invention is not limited to this example, but can be adapted to other processes, for example by the application of known godets. This is referred to again briefly following the description of the FIGS.

FIG. 1 shows, in schematic form, a part of a nozzle plate 10, a single hole 12 in this plate 10, through which a melt 14 is pressed by devices which are not illustrated, and the resultant filament 16. For reasons of simplicity only one filament 16 is shown however, as known, a number of filaments 16 can be formed at the same time (each through a single hole in the plate 10). The process illustrated in FIG. 1 is completed by the filament 16 being wound on to a bobbin 18 in a winding unit (winder or spooler) 20.

The initially liquid polymer is cooled between the nozzle plate 10 and the winder 20, this cooling being effected by the transfer of heat from the hot polymer to the gas (the air) surrounding it. The transfer of heat continues at least until the polymer material has set (solidified), this solidification occurring at an ascertainable point (or, at least, within an ascertainable range) in the yarn run. The "solidification point" is indicated in FIG. 1 at the location EP, this location being liable to being substantially affected by the spinning conditions (see the above-mentioned article from the journal Chemiefaser/Textilindustrie, September 1992).

Above the solidification point EP (i.e., between this point and the nozzle plate 10), the filament tapers, its cross-section decreasing relative to its initial cross-section at the point at which it is pressed from the hole 12. Below the solidification point EP there is no further (significant) change in the cross-section of the filament. The speed of a "polymer particle" between the nozzle plate and the winder is therefore subject to highly complex effects, some of which have not yet been investigated. Following setting of the polymer, this speed (the "spinning speed") is determined solely by the winder 20. This speed then prevails from the solidification point EP to the winder 20.

In the currently conventional process, a relative motion occurs between the filament and its contiguous air layer. The speed of the filament relative to the air layer is determined by a number of factors, e.g.

- whether the yarn run is separated from the general room air by any means
- whether there are special means to move the air in the vicinity of the yarn and, if so, in which direction.

The friction between the filament and the contiguous air layer normally results in the air being "drawn along" with the yarn in the running direction of the yarn. The forces acting on a section of yarn at any point on the thread run are therefore:

- Fb—the accelerative force
- Fr—the forces resulting from the air friction
- Fs—the gravitational force
- FR—the resultant force which must be applied by the winder.

From this is obtained the relationship $$FR=Fb+Fr-Fs$$

wherein, in a first approximation, the gravitational force can be disregarded.

These variables do not represent a full description of the spinning process. A number of variables have been disregarded, for the purpose of concentrating on those concepts which are substantive to the invention. A more precise description of the process given by, for example, the following article: "Model of Steady-State Spinning At Intermediate Take-Up Speeds", Henry H. George in "Polymer Engineering and Science", April 1992, Vol. 22, No. 5, Page 292 ff.

The stress produced in the said section of yarn is therefore given as follows:

$$\text{Stress} = \frac{FR}{Q}$$

wherein Q is the magnitude of the area of the crosssection of the said section of yarn. The stress, the resultant force FR and the area magnitude Q are all a function of the distance from the nozzle plate 10.

At the point immediately after the filament emerges from the spinning nozzle, the filament stress is scarcely affected by air friction due to the fact that in this area the filament speed is relatively low. In this area, the stress is dependent on the acceleration and the viscosity in the longitudinal direction. However, after the acceleration has raised the filament speed above a certain limit, then a significant additional stress is produced unless measures are taken to prevent or limit this additional stress.

The level or the stress on solidification of the filament determines certain filament characteristics (including e.g. elongation at break, breaking strength, boiling shrinkage). The greater this stress, for example in POY spinning, the lower will be the values attainable for elongation at bread and boiling shrinkage,.

"Mathematically", therefore, there are two possible ways of positively influencing the values: number On the one hand, the resultant force FR can be reduced. In the conventional process, this results in a reduction of the yarn speed.

On the other hand, the area value Q prior to solidification can be increased (i.e. for given decitex per filament).

In practice, both of these "mathematical" options can be used, as described below with reference to FIG. 2.

The elements in FIG. 2 are essentially the same as those shown in FIG. 1, and they are identified by the same references. The difference is that means are provided (not illustrated in FIG. 2) to generate an air current LS in the running direction of the yarn. The air current LS forms the air layer which is then contiguous with the filament 16 above the solidification point EP, the air layer flowing at a speed VR, in the running direction of the yarn, which matches (or almost matches) the speed of the surface of the filament. This then results in the frictional forces Fr becoming negligible, thereby reducing the resultant force FR. The air current LS first contacts the filament 16 at a point EB which is located at a distance A below the plate 10 and it remains in contact with the filament up to the solidification point EP.

The assistance of the yarn movement above the solidification point EP reduces the stress in each section of yarn between the nozzle plate and the point EP. This reduction of filament stress prevents "necking"—the sudden tapering of the filament cross-section which occurs just before solidification and thereby reduces the cross-section of the solidified filament—at yarn speeds which are significantly higher than those which currently result in necking.

FIG. 3 shows a first embodiment for practical realization of the new principle. The nozzle plate is now indicated by reference 25, the winder by reference 27 and the bobbin forming within the winder by reference 28. A number of filaments 29 are formed in the plate 25 (three are shown in the FIG.), these being combined at a predefined point P to form one yarn F. A spin finish lubricant is applied before the winder 27 by means of a metering unit 31, with entangling being created by the unit 33 if necessary. Not illustrated in this FIG. is the metering pump which feeds melt to the spinning nozzle 25 at a predefined volume per unit of time. This volume, together with the number of holes in the nozzle plate and the spinning rate, determines the thickness of each of the filaments, the so-called decitex per filament. Thus far, the process is the same as the currently conventional process.

In order to create the rapidly flowing air layer the yarn run above the solidification point EP is enclosed in a spinning tube 35. This tube carries an air current produced by a negative-pressure generator 37. The upper end 39 of the tube 35 is open, thereby allowing the entry of air from the room which then forms the said air current within the tube. The lower end 41 of the tube 45 opens into an oblong chamber 43 which serves to connect the tube 35 and the negative-pressure generator 37, as described in greater detail below.

The chamber 43 forms an extension of the tube 35 in the running direction of the yarn so that, following its passage through the tube 35 and the chamber 43, the yarn can pass out of an outlet 45 without being deflected. The outlet 45 is constructed so that it does not hinder the yarn feed, but opposes the entry of room air into the chamber 43. Ceramic yarn guides 46 can be provided at the outlet 45. The distance between the outlet 45 and the unit 31 can be selected so that there can be no significant build-up of tension due to air friction on the solidified yarn.

The lower end section of the chamber 43 is formed as a perforated surface 47 and is enclosed by a collecting ring 49 which is connected to the negative-pressure generator 37 through a channel 51. Means are preferably provided, either in or on the channel 51, to enable the air current speed to be controlled, e.g. a valve 53, a restrictor 55 and a meter 57, the latter for measuring the differential pressure before and after the restrictor. Since such arrangements are known to specialists in the art they are not described further in this document.

The chamber 43 is connected to the tube 35 through a connection piece (a "trumpet") 58 which opens out in the running direction of the yarn. This reduces to some extent the high air speed within the tube 35 before the air enters the chamber 43. The air is slowed further in its passage from the chamber 43 into the collecting ring 49. These measures reduce the risk of turbulence in the air current. The reduction in the air speed below the tube 35 enables the yarn tension to be increased, which can be advantageous for winding. For the conventional winding process, the yarn feed-in tension should lie within the range of 0.08 to 0.15 CN/dtex.

For the same reason, a mouth piece ("funnel") 59, tapering in the running direction of the yarn, is provided above the upper end 39 of the tube 35. The inner surface of the funnel 59 (and, where applicable, also of the trumpet 58) is preferably of such a profile that a minimum amount of turbulence is created in the air current. The funnel 59 is disposed inside a perforated cylinder 61 through which air is sucked in from the room. This perforated cylinder 61 extends back to the heating box 63 which comprises the spinning nozzle 25. A second perforated cylinder 65 can be provided around the first cylinder 61 for the purpose of forming a settling space 67 which further helps to prevent air turbulence.

Variants of the Arrangement Illustrated

A roller (godet) or roller assembly can be provided after the outlet from the chamber 43 (before the winder). This can be used for drawing the "preliminary yarn" as it emerges from the chamber, used in the production of FDY or technical yarns. The godet could also be used simply to adjust the yarn tension before winding, without stretching it.

The perforate cylinder 61 can be constructed as a wire mesh, perforated metal sheet, sintered compact or fibre element. The minimum diameter of the cylinder 61 must be such that the still (thick) liquid filaments 29 do not contact the inner surface of the cylinder 61. The cylinder can have an axial length of between 5 and 200 cm.

The tube can have an inside diameter of e.g. 0.5 cm to 20 cm. The tube material is not important, provided that the filaments do not adhere on contact with its inner surface and provided that the wall itself does not melt. The inside diameter of the tube 35 relative to the negative pressure of the generator 37 is to be selected so that the required air speed is maintained within the tube 35. This air speed should preferably be equal to or greater than the spinning speed, i.e., the filament speed after solidification.

A protected zone Z can be provided between the spinning nozzle 25 and a point at which the inflowing air first contacts the filaments. This zone Z can be formed by mounting a ring 64 on the heating box 63, under the spinning nozzle 25. Alternatively, the heating box 63 itself can project below the spinning nozzle 25. The inflowing air can be preheated.

In order to reduce the risk of the filaments 29 contacting the inner surface of the tube 35, air-jet means 60 can be provided at the upper end 39 of the tube (between the tube 35 and the funnel 59) which inject air jets along the inner surface of the tube 35, in the direction of the tube axis. These air-jet means 60 can also be used to assist threading.

As mentioned above in the introduction to the description of the FIGS, the "simple" spinning line according to the FIGS. can be supplemented by additional units in order to achieve known effects. As examples of such arrangements (many of which are known to specialists in the art), reference is made here only to DE-A-21 17 659 and DE-C-40 21 545 which propose heating the yarn after solidification. DE 2117659 also provides for a roller assembly (godet pair) for stretching the yarn.

Figure 4:
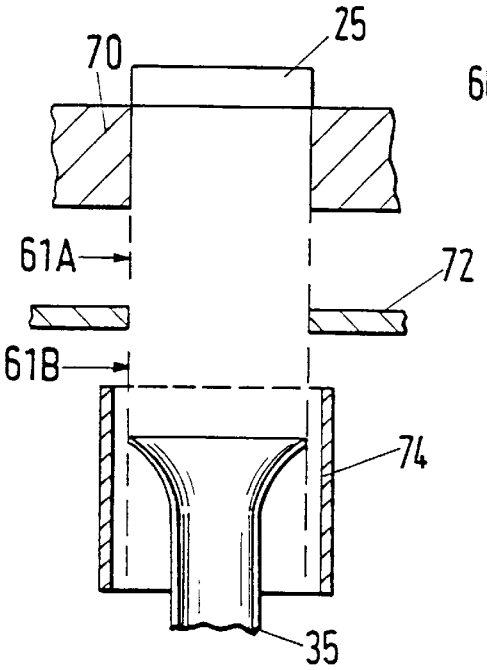
FIG. 4 shows a corresponding representation of a supplemented device for spinning very fine filaments.

FIG. 4 shows a variant which slows the cooling of the yarn in order to prevent sudden hardening of the polymer when it emerges from the spinning nozzle 25. In this case, the nozzle 25 is followed by a heated sleeve 70 which prevents a sharp drop in the yarn temperature. This effect is further assisted in that the cylinder 61 is divided by a divider 72 into an upper section 61A and a lower section 61B, with warm air being delivered to the cylinder section 61A above the divider while the relatively cool room air is allowed to enter the cylinder section 61B.

The air current within the tube 35 could be formed by air being blown into the upper end of the tube.

The air speed on entry into the tube 35 can be adjusted by means of a diaphragm 74 surrounding the cylinder 61 and capable of displacement relative to the cylinder in the running direction of the yarn. The diaphragm 74 is not perforated and thus limits the entry of the room air to the perforated cylinder 61 (or allows the air to enter, when the diaphragm 74 is moved downwards).

As explained above, the air speed within the tube 35 should be the same as the yarn speed. The room air which forms the air current within the tube should preferably be sucked in as a so-called "cross-flow" (perpendicular to the length of yarn). This inflow of room air must not exhibit any turbulence which could cause irregularities in the yarn characteristics. The volume of air must therefore be limited as much as possible (through the selection of a relatively small diameter of the tube 35), since larger volumes of air involve increased risk of turbulence.

Advantageous Effect of the Invention, Application Examples

The effect of a higher filament stress is to increase the crystallinity and orientation of the polymer structure. Accordingly, the effect of the invention is to limit the crystallization or orientation. The preferred areas of application are therefore those in which these effects offer the greatest advantages. In order to explain this, a distinction must first be made between the following "yarn types":

(a) Technical yarns these yarns are currently produced in two stages, with a "preliminary yarn" being spun in the first stage and this (set) preliminary yarn being drawn in the second stage for the purpose of significantly increasing its strength. In the preliminary yarn, both the crystallinity and the orientation should be as low as possible, so as to permit maximum stretching in the second stage. For the sake of completeness, it must be mentioned here that the said stages are carried out in "two steps" or in "one step". In the so-called two-step process, the preliminary yarn is wound at low speed and the bobbin is transported to another machine for stretching. In the "one-step process" the preliminary yarn is stretched on a godet assembly prior to winding.

(b) POY textile yarns these "partially oriented yarns" serve as preliminary yarn for a further process, namely, stretching or draft texturing. In order for optimum effects to be achieved in the second stage, the crystallinity should not exceed a certain upper limit. PES yarns, for example, preferably have a maximum crystallinity of 20%, giving an elongation of about 80 to 150% and a boiling shrinkage of about 50 +/− 10%.

(c) FDY textile yarns—these "fully drawn yarns" are suitable for final use without any further processing stages. In this case, a higher crystallinity is acceptable, e.g. PES-FDY yarn about 20 to 50%, giving an elongation of 25 to 45%, a strength of 3 to 5 CN/dtex and a boiling shrinkage of 0 to 10%.

These examples clearly illustrate that although the acceptable crystallinity varies widely depending on the area of application there is nevertheless an upper limit for each application.

The invention, which influences the degree of crystallinity or orientation for a given air speed, can therefore be used to achieve the following effects:

Spinning yarns with predefined characteristics at delivery speeds which are higher than the currently conventional speeds (e.g. spinning POY yarns with 0.5 to 30 decitex per filament at delivery speeds of between 7000 and 8000 m/min., instead of at the currently standard speeds of 2500 to 5500 m/min., while maintaining the currently known yarn characteristics).

Spinning filaments or filaments from certain polymers at economic delivery speeds in cases where this is not currently possible (e.g. spinning PES POY yarns of about 0.1 to 0.5 decitex per filament at delivery speeds of about 3000 m/min.).

The following modifications of known processes for spinning certain yarn types are given as examples of the applicability of this invention:

Known Process for FDY PES Yarn

A PES (polyester) yarn is delivered to a godet assembly at a speed of about 3600 m/min. (without winding). The assembly introduces a draft of about 1.45 and the stretched yarn is wound at a spinning rate of about 5200 m/min, giving a yarn of up to 6 decitex per filament.

New Process for FDY PES Yarn

By means of this invention, the speed of delivery to the godet assembly is increased to about 7000 m/min., without significantly altering the characteristics of the reference yarn. The draft remains unchanged, so that the characteristics of the known yarn are maintained. The winding-off speed is increased to over 10,000 m/min.

Known Process for Technical Yarns (e.g. cord fabric)

PES or PA (polyamide) yarn is delivered to a godet assembly at a speed of between 400 and 600 m/min (e.g. PES cord fabric, approx. 400 m/min). Following stretching in the godet assembly, the yarn is wound at a winding off rate of between 2000 and 3500 m/min (e g. PES cord fabric, 220 to 2500 m/min.). The wound yarn has a strength of between 7 and 9 g/den with up to 10 decitex per filament.

New Process for Technical Yarns

Through the application of this invention, the yarn can be delivered from the nozzle to the godet assembly at a speed of over 1000 m/min., with characteristics remaining the same as for the known process. This enables the winding-off speed to be increased to over 5500 m/min., with the characteristics of the wound yarn remaining the same as for the known process.

Known Process of HMLS Yarn

"High modulus, low shrinkage" (HMLS) yarns have recently been used for cord fabric. In spinning, a PES yarn is delivered at a speed of 3000 to 3500 m/min. to a godet assembly, where the preliminary yarn is stretched. The stretched yarn is wound at a winding-off speed of about 6000 m/min. In spite of its relatively high orientation and high crystallinity, this yarn can meet the requirement profiles of certain applications.

New Polymers for HMLS Yarn

The HMLS process cannot be straightforwardly transferred to other types of polymer, since other polymers react differently to the spinning conditions. Under the stated spinning conditions, polypropylene (PP) and PA (incl. PA 6.6) would exhibit a much higher crystallinity than PES even on the first godet, which would result in problems in stretching. The invention can be applied to such cases to reduce this unacceptable crystallinity.

When a filament is processed at stress levels below a certain limit, the filament tapers steadily up to the solidification point, solidification occurring at the co-called glass temperature. If the stress is increased the polymer solidifies above the glass temperature (even if the cooling conditions remain otherwise unchanged), this solidification being accompanied by increasing crystallization. This substantially increases the risk of "necking".

At higher yarn speeds, there remains the risk of filament breakage. This risk is greatly reduced by a reduction of the stress, but it could also be advantageous to adjust other spinning conditions to reduce (control) this risk even further. Such conditions include, for example, the acceleration, the elongation per unit length ($^{ax}$/X) and the cooling. These conditions can be affected by the following process parameters: the distance A (upper end of the tube to the nozzle plate), the tube length, the air current speed and the air temperature. By these means it is possible to produce spinning conditions which are approximately the same as the currently conventional conditions.

It is not a primary objective of this invention to achieve effects through temperature changes, as in the case of e.g. EP 456 505. However, it can be combined very well with processes which rely on heat treatment, as explained below with reference to FIGS. 5 and 6. In these FIGS, parts which are the same as those in the embodiment according to FIG. 3 are indicated by the same references.

Figure 5:
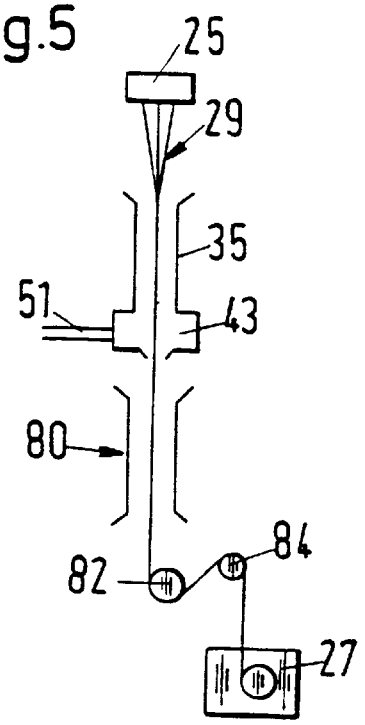
FIG. 5 is a schematic diagram of an expanded process.

Accordingly, the embodiment according to FIG. 5 comprises, for example, a spinning nozzle 25, a tube 35, a chamber 43 and an air draft 51. The area between the nozzle 25 and the tube 35 is not indicated in detail in FIG. 5, but can be deduced from FIG. 3 or FIG. 4.

In FIG. 5, there is a heat treatment channel 80 below the chamber 43. Within this channel, the solidified yarn is reheated to a temperature above the glass point (but below the melt temperature) by hot air (temperature e.g. 200 to 240° C.) flowing upwards. The yarn emerging from the channel is delivered to a godet pair 82, 84, but the yarn is not stretched by the godets. The tension of the thread entering the godet pair is such that the yarn is stretched on a stretching or elongation point DP in the channel. The thread tension after the godet pair is that appropriate for winding the thread in the winder 27.

Figure 6:
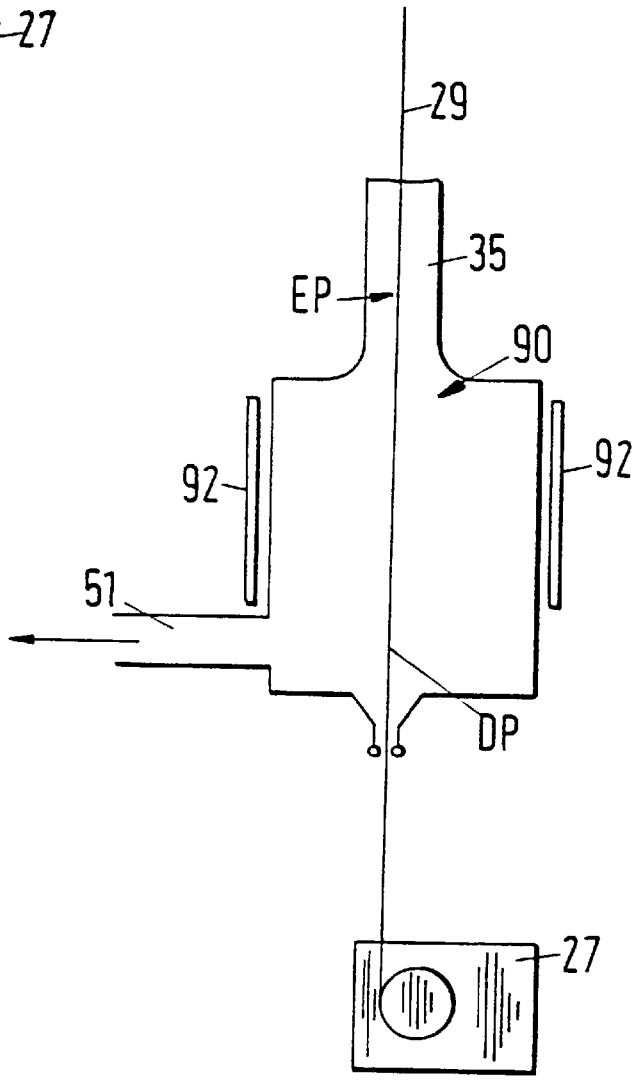
FIG. 6 shows, in schematic for, a preferred variant of such an expanded process.

A preferred variant of this expanded process is shown in schematic form in FIG. 6, in which the heat treatment is integrated into the device provided for this invention. FIG. 6 shows the lower end section of the tube 35 (in the vicinity of the solidification point EP).

The chamber 43 of FIG. 3 has now been replaced by a relatively larger enlargement channel 90 for the purpose, for example, of reducing the air current speed from about 7000 m/min to about 500 m/min.

The air flowing slowly within the channel 90 is heated by a heating means 92 so that the yarn attains a temperature above the glass point but below the melt point. The slowing of the air current also increases the air resistance (air friction), resulting in a correspondingly increased thread tension. This produces a stretching or elongation point DP in the lower part of the channel 90. The stretching increases the crystallinity, producing a low boiling shrinkage. Yarns produced by this process can be used directly in textile applications (e.g. knitting, weaving).

I claim:

1. A process for melt spinning a multifilament yarn comprising the steps of extruding a heated polymeric melt through a nozzle to form a plurality of downwardly advancing filaments which are in liquid form during an initial portion of their advance and which become solid upon reaching a solidification point which is spaced below said nozzle, generating an air current so as to flow along with the advancing filaments over at least a portion of the length of their advance and while the filaments are in liquid form, with the speed of the air current at least closely matching the speed of the advancing filaments in such a way that only insignificant frictional forces are produced between the filaments and the contiguous air layer, so as to reduce the air drag forces acting on the filaments and thereby reduce the filament stress at solidification, gathering the advancing filaments to form an advancing multifilament yarn, and winding the advancing multifilament yarn into a package.

2. The process as defined in claim 1 wherein the step of generating an air current includes causing the current to flow along with the advancing filaments under substantially non-turbulent conditions.

3. The process as defined in claim 2 wherein the speed of the air current matches or closely matches the speed of the advancing filaments.

4. The process as defined in claim 1 wherein the step of generating an air current includes bringing the air current into initial contact with the advancing filaments at a point spaced a short distance below the nozzle, and so as to avoid a sharp drop in temperature of the extruded filaments immediately below the nozzle.

5. The process as defined in claim 1 wherein the step of generating an air current includes causing the air current to flow along with the advancing filaments at least to a point immediately adjacent the solidification point.

6. The process as defined in claim 1 wherein the step of generating an air current includes guiding the current with in an elongate non-perforated tube which surrounds the advancing filaments upstream of the solidification point.

7. A process for melt spinning a multifilament yarn comprising the steps of extruding a heated polymeric melt through a nozzle to form a plurality of downwardly advancing filaments which are in liquid form during an initial portion of their advance and which become solid upon reaching a solidification point which is spaced below said nozzle, generating an air current so as to flow along with the advancing filaments over at least a portion of the length of their advance and while the filaments are in liquid form, with the speed of the air current matching or closely s matching the speed of the advancing filaments in such a way that only insignificant frictional forces are produced between the filaments and the contiguous air layer, and including bringing the air current into initial contact with the advancing filaments at a point spaced a short distance below the nozzle, and causing the air current to flow along with the advancing filaments at least to a point immediately adjacent the solidification point, so as to reduce the air drag forces acting on the filaments and thereby reduce the filament stress at solidification, and to thus permit the production of yarns of low orientation at high winding speeds, gathering the advancing filaments to form an advancing multifilament yarn, and winding the advancing multifilament yarn into a package.

8. The process as defined in claim 7 wherein the step of generating an air current includes guiding the current within an elongate non-perforated tube which surrounds the advancing filaments and extends between the point at which the air current is brought into initial contact with the advancing filaments and the solidification point of the filaments, and measuring and controlling the air velocity within the non-perforated tube, and comprising the further step of applying a spin finish to the advancing yarn at a location between the non-perforated tube and the winding step.

9. A melt spinning apparatus for producing a multifilament yarn, comprising an extruder for heating a polymeric material and extruding the resulting melt through a nozzle to form a plurality of downwardly advancing filaments which are in liquid form during an initial portion of their advance and which become solid upon reaching a solidification point which is spaced below said nozzle, a cooling chamber disposed below the nozzle of the extruder for generating an air current which flows along with the advancing filaments over at least a portion of the length of their advance and while the filaments are in liquid form, said cooling chamber comprising a non-perforated tube which surrounds the advancing filaments, said non-perforated tube having an upper end located at a point spaced a short distance below the nozzle of the extruder and a lower end, and wherein the cooling chamber includes means for drawing a negative pressure at the lower end of the tube such that outside air is drawn into the upper end of the tube and flows therethrough to the lower end, with the speed of the air current at least closely matching the speed of the advancing filaments in such a way that only insignificant frictional forces are produced between the filaments and the contiguous air layer, guide means for gathering the advancing filaments to form an advancing multifilament yarn, a winder for winding the advancing multifilament yarn into a package, and a converging funnel mounted coaxially at the upper end of the tube for reducing turbulence in the air as it enters the tube.

10. The melt spinning apparatus as defined in claim 9 further comprising a perforated sleeve extending downwardly from the nozzle and so as to encircle the upper end of the tube and the funnel for further reducing the turbulence in the air as it enters the tube.

11. The melt spinning apparatus as defined in claim 9 wherein the means for drawing a negative pressure at the lower end of the tube includes an adjustable diaphragm for adjusting the speed of the air current passing through the tube, and further comprising a spin finish applicator for applying a spin finish to the advancing yarn at a location between the lower end of the tube and the winder.

12. The melt spinning apparatus as defined in claim 9 further comprising a ring positioned to encircle the advancing filaments immediately below the nozzle so as to restrict outside air from moving laterally into contact with the advancing filaments.

13. The melt spinning apparatus as defined in claim 9 wherein the lower end of the tube is in the form of a divergent cone so as to reduce turbulence when the air decelerates through the lower end of the tube.

14. The process as defined in claim 6 wherein the upper end of the tube is open to thereby allow the entry of air from the surrounding room which then forms the air current within the tube.

15. The process as defined in claim 14 wherein the tube includes a lower end which opens into a chamber which forms an extension of the tube, and wherein the step of generating an air current includes generating a negative pressure in said chamber.

16. The process as defined in claim 15 wherein the filaments pass through said chamber and exit via an outlet without having been deflected, the outlet being sized and configured to oppose the entry of room air therethrough and into said chamber, and without hindering the advance of the yarn.

17. The process as defined in claim 15 wherein a funnel which converges in the advancing direction of the filaments is positioned adjacent the upper end of the tube such that the air entering the tube enters through said funnel.

18. The process as defined in claim 17 wherein said chamber is connected to said tube via a connecting trumpet which diverges in the direction of the advancing filaments.

19. The process as defined in claim 1 wherein the speed of the air current flowing with the advancing filaments is such that the frictional forces between the filaments and the contiguous air layer remain below a limit at which they can significantly affect the yarn characteristics.

20. The process as defined in claim 1 wherein the air current flows along with the advancing filaments to a point close to the solidification point, and wherein the speed of the air current flowing with the advancing filaments is such that the frictional forces between the filaments and the contiguous air layer between the nozzle and the solidification point are reduced such that no sudden tapering of the filament cross section occurs before solidification.

21. The process as defined in claim 1 wherein the heated polymeric melt comprises polyester, and comprising the further step of drawing the filaments at a ratio of about 1:1.45 to result in a polyester yarn having a crystallinity of 20 to 50%, an elongation of 25 to 45%, a boiling shrinkage of 0 to 10%, a strength of 3 to 5 cN/dtex, and a delivery speed of about 7000m/min.

22. The process as defined in claim 1 comprising the further steps of drawing the filaments to produce a POY yarn with 0.5 to 30 decitex per filament which is spun at a delivery speed of between about 7000 to 8000 m/min, and wherein the yarn has a maximum crystallinity of 20%, an elongation of about 80 to 150%, and a boiling shrinkage of about 50 +/− 10%.

23. The process as defined in claim 1 wherein the heated polymeric melt comprises polyester, and comprising the further step of drawing the filaments to result in a POY yarn having 0.1 to 0.5 decitex per filament which is spun at a delivery speed of about 3000 m/min.

24. The process as defined in claim 1 wherein a technical yarn is spun, and comprising the further step of delivering the spun yarn to a drawing godet assembly at a speed greater than 1000 m/min, drawing the yarn in a godet assembly, and then winding the yarn at a speed of more than 5500 m/min.

25. The melt spinning apparatus as defined in claim 9 wherein the lower end of the tube opens into a chamber, and wherein the negative pressure is generated in said chamber.

26. The melt spinning apparatus as defined in claim 25 wherein the filaments pass through said chamber and exit via an outlet without having been deflected, the outlet being sized and configured to oppose the entry of room air therethrough and into said chamber and without hindering the advance of the yarn.

27. The melt spinning apparatus as defined in claim 26 wherein said chamber is connected to the lower end of the tube via a diverging trumpet.

28. The melt spinning apparatus as defined in claim 9 further comprising a heated sleeve disposed immediately below the nozzle to prevent a sharp drop in the temperature of the filaments leaving the nozzle.

29. The melt spinning apparatus as defined in claim 10 wherein the perforated sleeve is divided into upper and lower sections, and further comprising means for delivering relatively warm air into the upper section and relatively cool air into the lower section.

30. The melt spinning apparatus as defined in claim 9 further comprising means for measuring and controlling the air velocity within the non-perforated tube.

* * * * *

UNITED STATES PATENT AND TRADEMARK OFFICE
CERTIFICATE OF CORRECTION

PATENT NO. : 5,976,431

DATED : November 2, 1999

INVENTOR(S) : Mears

It is certified that error appears in the above-identified patent and that said Letters Patent is hereby corrected as shown below:

Title page, [30] Foreign Application Priority Data, line 1, "3610/9314" should read --3610/93-4--.

Column 11, line 5, after "closely" cancel the "s".

Signed and Sealed this

Twenty-fifth Day of July, 2000

*Attest:*

*Attesting Officer*

Q. TODD DICKINSON

*Director of Patents and Trademarks*